US006058863A

United States Patent [19]

Stewart et al.

[11] Patent Number: 6,058,863

[45] Date of Patent: May 9, 2000

[54] PILLOW SHAM APPARATUS

[75] Inventors: Parks C. Stewart, Lawrenceville; Robert A. Trobaugh, III, Avondale Estates, both of Ga.

[73] Assignee: Phoenix Automation, Norcross, Ga.

[21] Appl. No.: 09/098,677

[22] Filed: Jun. 17, 1998

[51] Int. Cl.[7] ..... D05B 13/00; D05B 35/00

[52] U.S. Cl. ..... 112/470.36; 112/475.06; 112/304

[58] Field of Search ..... 112/470.36, 140, 112/141, 475.06, 304, 307

[56] References Cited

U.S. PATENT DOCUMENTS

| | | | |
|---|---|---|---|
| 3,126,848 | 3/1964 | Gastonguay | 112/470.36 X |
| 4,214,541 | 7/1980 | Zeigler, Jr. et al. | 112/475.06 |
| 4,353,316 | 10/1982 | Brocklehurst | 112/475.06 |
| 4,621,585 | 11/1986 | Ball et al. | 112/304 X |
| 4,624,198 | 11/1986 | Beam et al. | 112/304 X |
| 4,856,439 | 8/1989 | O'Neal et al. | 112/307 X |
| 5,619,942 | 4/1997 | Stewart et al. | 112/470.07 |
| 5,669,320 | 9/1997 | Stewart et al. | 112/470.07 |
| 5,685,248 | 11/1997 | Stewart et al. | 112/470.07 |

*Primary Examiner*—Ismael Izaguirre
*Attorney, Agent, or Firm*—Jones & Askew LLP

[57] ABSTRACT

An apparatus for manufacturing a pillow sham from a sheet of material. The apparatus includes one or more hemmers positioned on a predetermined path for hemming one or more lateral edges of the sheet, a tri-fold assembly positioned on the predetermined path such that the sheet is folded into a front panel, a first back panel, and a second back panel, and one or more sewing assemblies positioned on the predetermined path such that the panels are sewn into place.

32 Claims, 4 Drawing Sheets

PILLOW SHAM APPARATUS

TECHNICAL FIELD

The present invention relates to a textile product finishing apparatus and more particularly relates to an apparatus that automatically hems, folds, and sews a piece of material into a high quality pillow sham.

BACKGROUND OF THE INVENTION

A pillow sham is an ornamental covering for a pillow and a traditional bedding accessory. The design of a typical pillow sham is shown in FIG. 1. The sham 10 may be made from a single sheet 15 of material such as cotton, a blended cotton/synthetic material, or other types of traditional textile materials. The sheet 15 is generally hemmed along its lateral edges 20 and then folded twice to create a front side 25 with two (2) overlapping back panels 30 and 35. The transverse edges 40 of the sheet 15 are then sewn together. A manufacturer's label 50 may be sewn into one of the lateral edges 20. The sham 10 is then turned rightside out (the sham 10 is generally made inside out), packaged, and shipped. In use, the user places a pillow (not shown), in an opening 60 created between the overlapping panels 30, 35.

Traditionally, pillow shams 10 have been hemmed, folded, and sewn by hand in the process described above. Such a process, however, is labor intensive. The production volume in the manual process is relatively low. Further, high quality was not always achieved in the manual process because a pillow sham demands uniform hems and folds.

What is needed, therefore, is a method and an apparatus for manufacturing pillow shams. The method and the apparatus must be accurate so as to create a high quality pillow sham in a high speed manner.

SUMMARY OF THE INVENTION

The present invention provides an apparatus for manufacturing a pillow sham from a sheet of material. The apparatus includes means for hemming one or more lateral edges of the sheet, means for folding the sheet such that a front panel, a first back panel, and a second back panel are created, and means for sewing one or more transverse edges of the sheet such that the panels are sewn into place.

Specific embodiments of the apparatus include the use of one or more hemmers as the hemming means. The hemmers include one or more sewing heads, one or more fold elements, and one or more roller arms. One of the hemmers is positioned on a first side of a predetermined path while another of the hemmers is positioned on a second side of the path. The means for folding the sheet include a tri-fold assembly having one or more skis and one or more movable plates positioned adjacent to the skis. The panels fold the sheet over the skis to create the panels. The means for sewing the transverse edges of the sheet include one or more sewing assemblies having one or more sewing heads. One sewing assembly is positioned on either side of the predetermined path.

The apparatus further includes means for pulling a continuous strip of the sheet material onto the predetermined path and means for cutting the sheet from the strip of material. The means for pulling the strip include an unwind assembly, a dancer assembly, a push assembly, and a feed pull assembly. The apparatus also includes means for stacking the pillow shams.

The method of the present invention includes the steps of advancing a continuous strip of material along a predetermined path, cutting a sheet from the strip, hemming one or more lateral edges of the sheet, folding the sheet so as to create a front panel, a first back panel, and a second back panel, and sewing one or more transverse edges of the sheet such that the panels are sewn into place.

Thus, it is an object of the present invention to provide a pillow sham apparatus.

It is a further object of the present invention to provide an apparatus that produces pillow shams in a high speed manner.

It is a still further object of the present invention to provide an apparatus that produces pillow shams in a uniform and high quality manner.

It is yet another object of the present invention to provide a pillow sham apparatus that accurately measures, cuts, hems, folds, sews, and stacks a pillow sham.

Other objects, features, and advantages of the present invention will become apparent upon reading the following specification when taken in connection with the drawings and the claims.

DETAILED DESCRIPTION OF THE INVENTION

Figure 1:
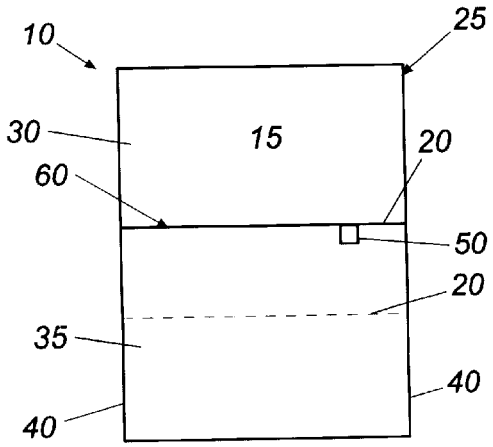
FIG. 1 is a plan view of a pillow sham manufactured by the present invention with the edge of the interior panel shown in phantom lines.
Figure 4:
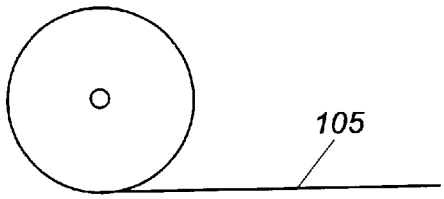
FIG. 4 is a plan view of the continuous strip of sheet material.
Figure 2:
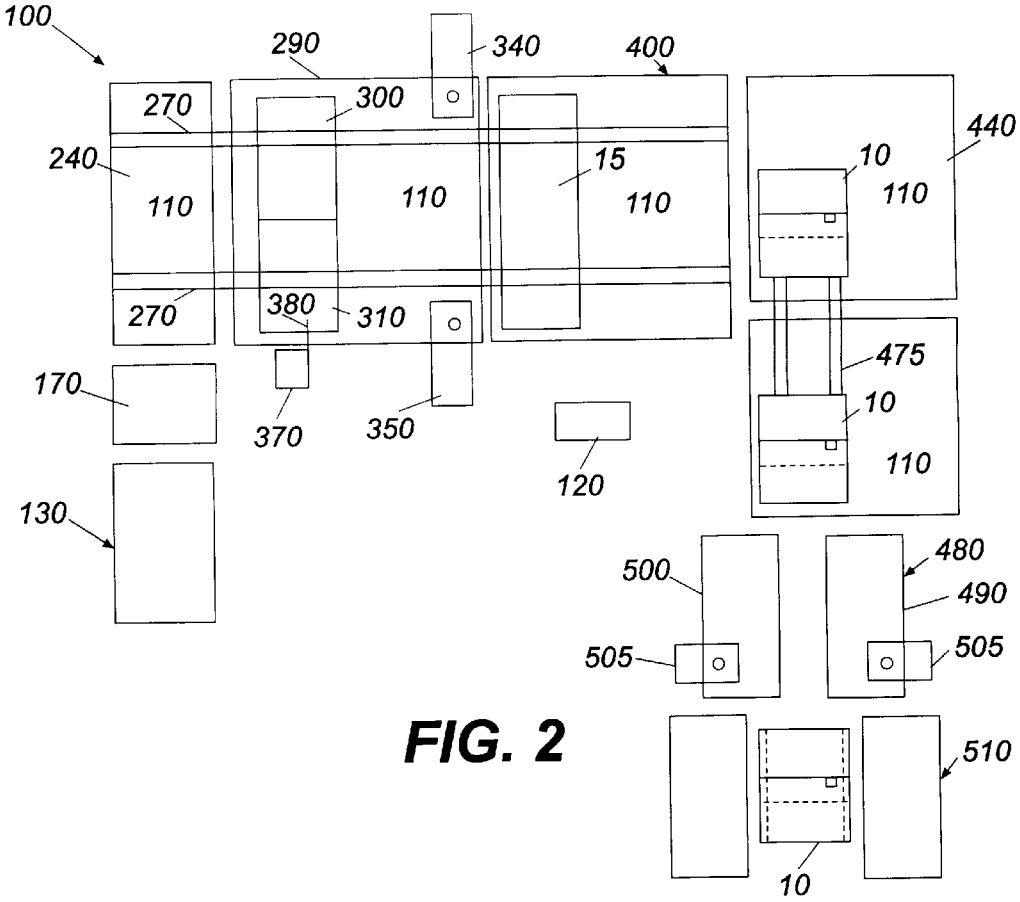
FIG. 2 is a schematic view of the components of the present apparatus.
Figure 3:
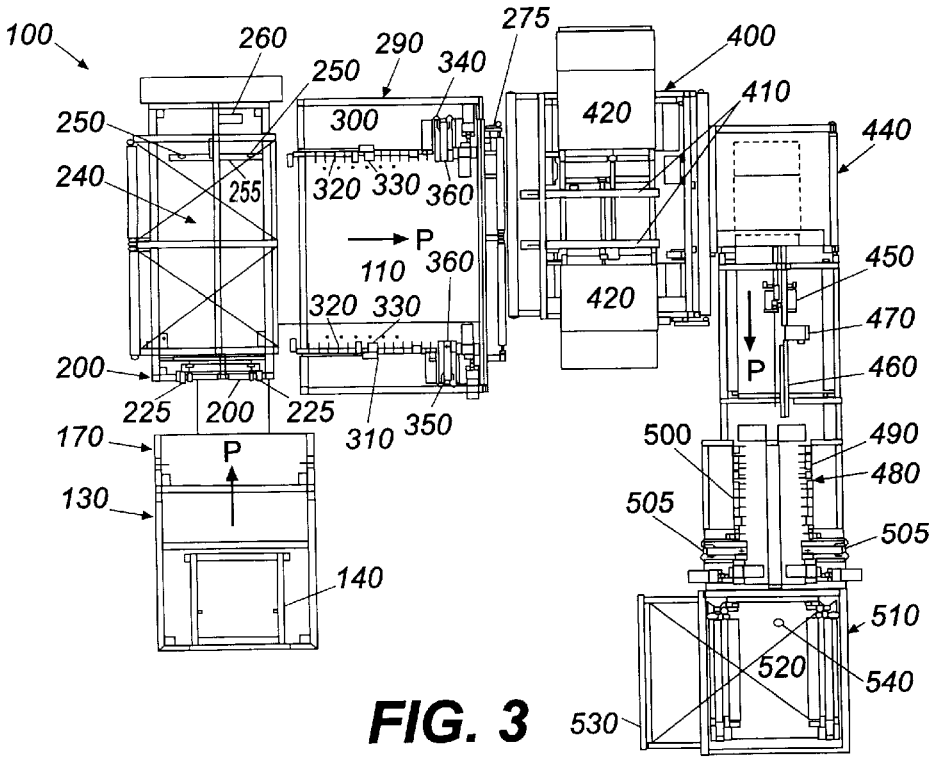
FIG. 3 is a plan view of the components of the present apparatus.

Referring now to the drawings, in which like numerals represent like parts throughout the several views, FIGS. 2 and 3 show a pillow sham apparatus 100 of the present invention. The pillow sham apparatus 100 cuts and hems the pillow sham 10 from the single sheet 15 of material. As is shown in FIG. 4, the single sheet 15 comes from a continuous strip 105 of the sheet material. The pillow sham apparatus 100 operates in an assembly line-type fashion along a tabletop 110. The sheet 15 advances along a predetermined path P across the tabletop 110 through the various stations described below to form the sham 10.

The various stations of the apparatus 100 are set, monitored, and controlled by a Programmable Logic Controller ("PLC") 120 such as the 90-30 PLC sold by the General Electric Company of Fairfield, Conn. Alternatively, a personal computer, such as a conventional IBM-compatible computer with the Pentium® microprocessor sold by Intel Corporation of Santa Clara, Calif. or its equivalent, may be used, or other types of conventional control devices.

Figure 5:
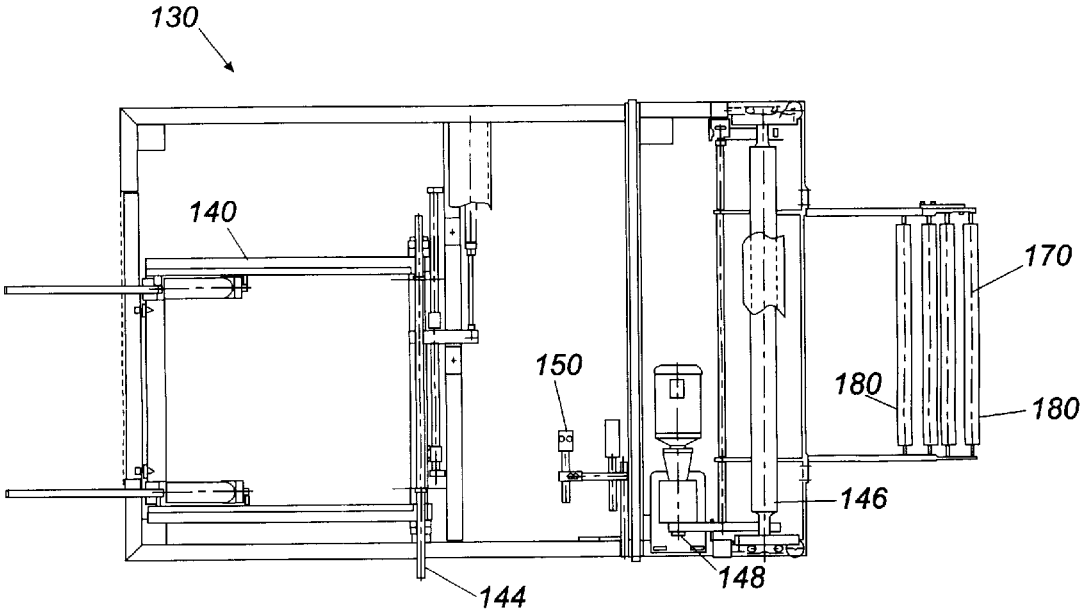
FIG. 5 is a plan view of the unwind assembly and the dancer assembly.
Figure 6:
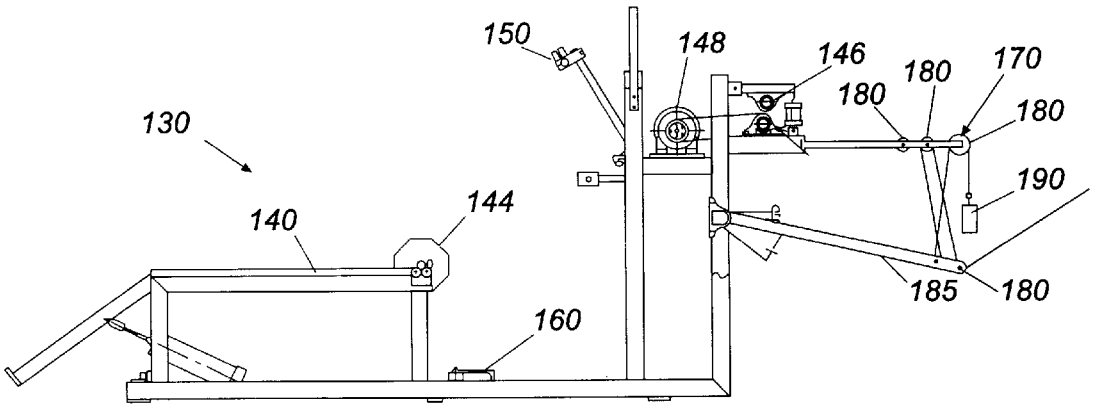
FIG. 6 is a side view of the unwind assembly and the dancer assembly.

The pillow sham apparatus 100 may include an unwind assembly 130 positioned along the predetermined path P and adjacent to the tabletop 110. As is shown in FIGS. 5 and 6, the unwind assembly 130 includes a carriage 140 upon which the continuous strip 105 of sheet material is positioned. The carriage 140 may include a conventional spool-shaped roller 144 or other type of conventional mounting. The continuous strip 105 is feed through a pair of belt-driven feed rollers 146 operated by a an AC motor 148 or other types of conventional drive means.

One or more positioning sensors 150 are positioned on the unwind assembly 130 adjacent to the carriage 140, with at least one (1) sensor 150 positioned adjacent to the predetermined path P. The positioning sensors 150 are conventional photo-eyes or other types of conventional electrical or mechanical sensors. The positioning sensor 150 ensures that the continuous strip 105 is unwound off of the carriage 140 in proper alignment with the predetermined path P. Proper positioning of the continuous strip 105 is necessary for a high quality pillow sham 10. The PLC 120 is informed if the sensor 150 detects that the continuous strip 105 is veering off of the predetermined path P. The carriage 140 may then be realigned to correct the positioning of the continuous strip 105.

A carriage sensor 160 also may be positioned on the unwind assembly 130 adjacent to the rollers 144. The carriage sensor 160 is a conventional photo-eye or other type of conventional electrical or mechanical sensor. The carriage sensor 160 detects the presence or the absence of the continuous strip 105 on the roller 144 so as to notify the PLC 120 when the continuous strip 105 is exhausted and the roller 144 needs to be replaced or refilled.

Adjacent to the unwind assembly 130 along the predetermined path P is a dancer assembly 170 to pull the continuous strip 105 off of the roller 144. The dancer assembly 170 includes a plurality of rollers 180 and a plurality of dancer arms 185 loaded with a counterweight 190. A proper length of the continuous strip 105, i.e., enough material to form a complete pillow sham 10, is pulled off of the roller 144 through the feed rollers 146 by the dancer assembly 170 under continuous tension.

Figure 7:
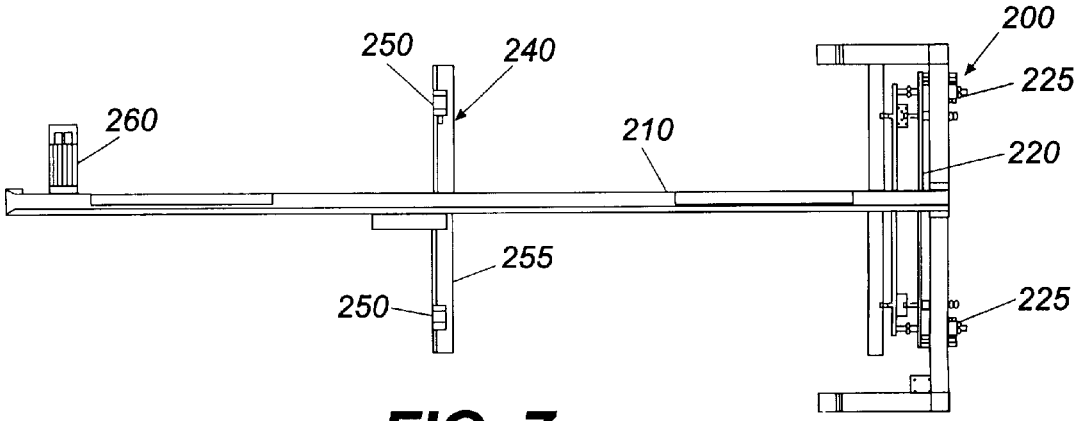
FIG. 7 is plan view of the feed pull assembly, the push assembly, and the cutting device as positioned on the gantry.
Figure 8:
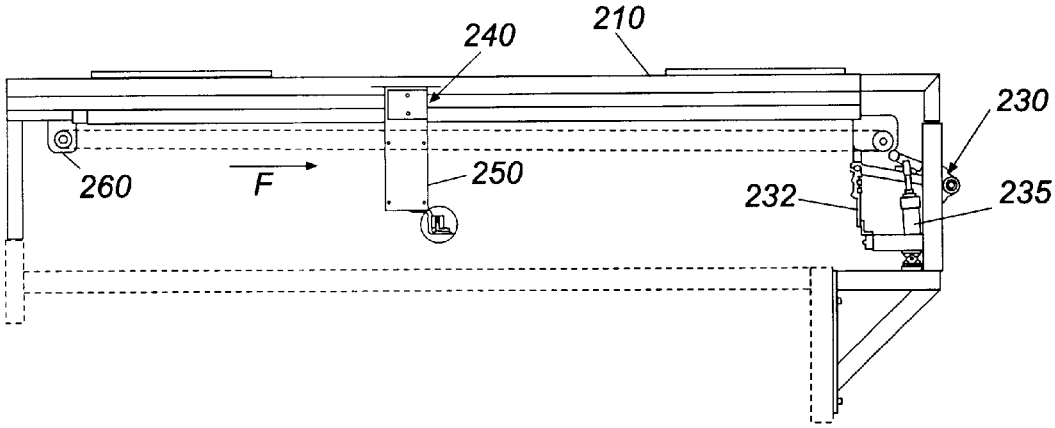
FIG. 8 is a side view of the feed pull assembly, the push assembly, and the cutting device as positioned on the gantry.
Figure 9:
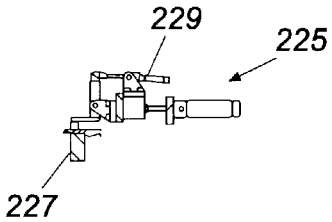
FIG. 9 is side view of the pushing element of the push assembly.

Adjacent to the dancer assembly 170 along the predetermined path P is a push assembly 200. As is shown in FIGS. 7–9, the push assembly 200 is positioned on a gantry 210 over the tabletop 110. The push assembly 200 preferably includes a pushing arm 220 with a plurality of pushing elements 225. As is shown in FIG. 9, the pushing elements 225 each have a blade 227 operated by an air cylinder 229. The air cylinders 229 push their respective blades 227 onto the continuous strip 105 as it emerges from the dancer assembly 170. The blades 227 advance the continuous strip 105 a short distance along the tabletop 110. The blade 222 is then elevated to clear the predetermined path P on the tabletop 110.

Adjacent to the push assembly 200 is a cutting device 230 that cuts the single sheet 15 from the continuous strip 105 of sheet material. As is shown in FIGS. 7–8, the cutting device 230 is mounted on the gantry 210 in the direction perpendicular to the predetermined path P. The cutting device 230 preferably has a shear blade 232 or other type of conventional blade, such as round blade or a band blade operated by an air cylinder 235. The cutting device 230 is capable of speeds of about twenty-five (25) cuts per minute. Alternatively, the cutting device 230 may be mounted within a slot (not shown) within the tabletop 110.

Positioned further along the predetermined path P on the tabletop 110 is a feed pull assembly 240. The feed pull assembly 240 includes one or more feed pull grippers 250 mounted on a gripping arm 255. The gripping arm 255 is positioned on the gantry 210 for movement in the direction of the predetermined path P. The feed pull grippers 250 are clamping devices that grab an appropriate amount of the continuous strip 105 of sheet material as it emerges from the push assembly 200. The gripping arm 255 and the feed pull grippers 250 are powered by a servo motor 260. The feed pull assembly 240 pulls the continuous strip 105 flat on the tabletop 110. After the continuous strip 105 is on the table top 110, the cutting device 230 cuts the individual sheet 15 from the continuous strip 105.

Referring again to FIGS. 2 and 3, after the sheet 15 is cut by the cutting device 230, the predetermined path P takes a perpendicular turn to minimize the overall size of the apparatus 10. The tabletop 110 has a plurality of belts 270 that run in the direction perpendicular to the feed pull grippers 250. The belts 270 are operated by AC servo motors 275. The belts 270 carry the sheet 15 into a hemming assembly 290. The speed of each of the belts 270 must be precisely matched so that the sheet 15 stays straight along the predetermined path P and the proper amount of material is formed into the hems.

The hemming assembly 290 includes two hemmers, a left hemmer 300 and a right hemmer 310. The hemmers 300, 310 are positioned on opposite sides of the predetermined path P along the tabletop 110. Each hemmer 300, 310 includes a plurality of roller arms 320 and a primary fold element 330. Because the hemmers 300, 310 are identical, only the left hemmer 300 will be described in detail. The roller arms 320 and the primary fold element 330 of the left hemmer 300 are positioned along the left edge of the predetermined path P in alignment with one of the lateral edges 20 of the sheet 15. The roller arms 320 are positioned on both sides of the primary fold element 330. The roller arms 320 keep this lateral edge 20 of the sheet 15 in line while the primary fold element 330 folds the edge of the sheet 15 over on to itself to form a fold. This fold is then kept in place by the further roller arms 320.

The hemming assemblies 290 also include two sew assemblies, a left sew assembly 340 and a right sew assembly 350, positioned adjacent to the roller arms 320. Because the sew assemblies 340, 350 are identical, only the left sew assembly 340 will be described in detail. The left sew assembly 340 includes a sewing head 360. The sewing head 360 is preferably powered by a 1.5 horsepower electrical motor (not shown). A Pfaff brand sewing or similar type of sewing head may be employed. Further, more than one type of sewing head 360 may be employed to give the apparatus 100 versatility in accommodating various types of materials or speeds. For example, the sewing head 360 may be a lock stitch head with a bobbin or a chain stitch head with no bobbin. The lock stitch head provides a uniform stitch that will not unravel. The chain stitch head, however, is significantly faster. After the fold is created by the primary fold element 330 as described above, the sheet 15 advances into the sewing assemblies 340, 350. The sewing head 360 sews along the fold to create the hem in the sheet 15.

The hemming apparatus 290 also may include a label insertion device 370. The label insertion device 370 includes a rotating arm 380 for placing a manufacturer's label 50 or other type of tag on one of the lateral edges 20 of the sheet 15 as it advances past the primary fold element 330 and prior to insertion into one of the sewing assemblies 340, 350. The appropriate one of the sewing assemblies 340, 350 then sews the label 50 into place.

Figure 10:
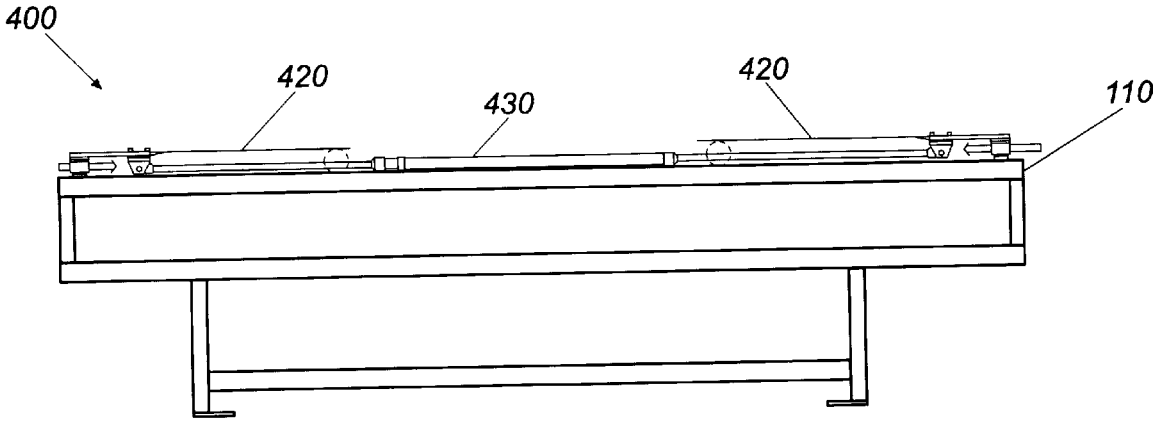
FIG. 10 is a side view of the tri-fold assembly.

The sheet 15 is then advanced into a tri-fold assembly 400. The tri-fold assembly 400 is positioned on the tabletop 110 along the predetermined path P. The tri-fold assembly 400 includes a pair of center skis 410 and a pair of moveable plates 420 positioned on either side of the skis 410. The moveable plates 420 operate in the direction perpendicular to the predetermined path P. As is shown in FIG. 10, the moveable plates 420 are powered by an air cylinder 430. After the sheet 15 is advanced into the tri-fold assembly 400 by the belts 270, the plates 420 move towards the center of the predetermined path P under the lateral edges 20 of the sheet 20 with one of the moveable plates 420 starting slightly ahead of the other. The moveable plates 420 cause the lateral edges 20 of the sheet 15 to be folded over the front side 25 with one back panel 35 landing on top of the other back panel 30. Alternatively, a blast of compressed air or similar methods may cause the panels 25, 35 to fold over on top of the back panel 30.

The sheet 15 is then advanced out of the tri-fold assembly 400 along the belts 270 into a transfer station 440. The transfer station 440 is positioned along the tabletop 110 along the predetermined path P. The transfer station 440 includes a gripper arm 450 mounted upon a gantry 460. The gripper arm 450 is operated by an AC motor 470. The gripper arm 450 grabs the sheet 15 as it emerges from the tri-fold assembly 400 and places the sheet 15 onto a second series of belts 475. The gripper arm 450 ensures that the folds of the sheet 15 are maintained in a uniform fashion. The belts 475 run in a direction perpendicular to the direction in which the sheet emerges from the tri-fold assembly 400. The predetermined path P therefore takes another perpendicular turn to ensure that the apparatus 100 takes up as little space as possible.

The belts 475 advance the sheet 15 into a second sew assembly 480. The second sew assembly 480 is positioned along the tabletop 110 along the predetermined path P. The second sew assembly 480 also includes two (2) sewing assemblies, a left sewing assembly 490 and a right sewing assembly 500, positioned on opposites sides of the predetermined path P. The sewing assemblies 490, 500 each include a sewing head 505. The sewing head 505 may be identical in design to the sewing head 360 described above. Generally, a chain stitch head is used to achieve the highest speed possible. The sew assemblies 490, 500 sew the transverse edges 40 of the sheet 15 such that the panels 25, 30, 35 are held in place and the pillow sham 10 is formed. The transverse edges 40 are sewn about one-half inch from the edge of the material The pillow sham 10 is then advanced by the belts 475 into a stacking device 510. The stacking device 510 is positioned along the predetermined path P at the end of the tabletop 110. The stacking device 510 includes a trap door 520, a conveyor roller 530, and one or more sensors 540. The trap door 520 is operated by a air cylinder (not shown) or other type of conventional lift mechanism. The conveyor roller 530 is operated by a gear motor (not shown) or other type of conventional design. The sensor 540 may be a photo-eye or any type of conventional electrical or mechanical sensor. As the pillow sham 10 is advanced into the stacking device 510, the pillow sham 10 is pushed on to the trap door 520. The sensor 540 is positioned adjacent to the trap door 520 such that when the pillow sham 10 passes under the sensor 540, the trap door 520 is activated and the pillow sham 10 is allowed to fall on to the conveyor 530. After a plurality of pillow shams 10 reach a preset height, the conveyor roller 530 indexes the stack of pillow shams 10 away such that the next stack may be started Conversely, any type of conventional stacking device and/or conveyor may be used.

In use, the continuous strip 105 of sheet material is positioned on the carriage 140 of the unwind assembly 130. The positioning sensor 150 is positioned on the unwind assembly 130 to ensure that the continuous strip 105 is advanced in a uniform fashion and in proper alignment with the predetermined path P. A predetermined length of the continuous strip 105 is pulled off of the carriage 140 by the dancer assembly 170. As the continuous strip 105 emerges from the dancer assembly 170, the push assembly 200 pushes a small amount of the continuous strip 105 on to the tabletop 110. This edge of the continuous strip 105 is then grabbed by the feed pull grippers 250 of the feed pull assembly 240. The feed pull grippers 250 advance the continuous strip 105 on to the tabletop 110. The cutting device 230 positioned adjacent to the push assembly 200 then cuts the sheet 15 from the continuous strip 105.

The plurality of belts 270 operated by the AC servo motor 390 are positioned along the table top 110 to advance the sheet 15 into the hemming apparatus 290 in a uniform fashion. The hemming apparatus 290 folds and hems the lateral edges 20 of the sheet 15. A label 50 also may be inserted onto the edges of the sheet 15.

The belts 270 then advance the sheet 15 into the tri-fold apparatus 400. The respective panels 30, 35 of the sheet 15 are then folded over the pair of skis 410 by the moveable plates 420. The folded sheet 15 is then advanced by the belts 270 into a transfer station 440. The transfer station 440 positions the sheet 15, with the folds maintained, into a second sew assembly 480 by a second series of belts 475. The transverse edges 40 of the sheet 15 are sewn in the second sew assembly 480 such that the pillow sham 10 is created. The sewn pillow sham 10 is then advanced into a stacking device 510 where a plurality of pillow shams 10 are stacked and advanced out of the apparatus 100 by the conveyor roller 530.

From the foregoing description of the preferred embodiment and the several alternatives, other alternative constructions of the present invention may suggest themselves to those skilled in the art. The scope of the present invention, therefore, is to be limited only by the claims below and equivalents thereof.

We claim:

1. An apparatus for manufacturing a pillow sham from a sheet of material, comprising:

means for hemming one or more lateral edges of said sheet, said means for hemming positioned on a predetermined path;

means for folding said sheet along two substantially parallel fold lines to create a pillow sham front panel defined on two opposing edges by said two fold lines, a pillow sham first back panel, and a pillow sham second back panel, said means for folding positioned on said predetermined path; and means for sewing one or more transverse edges of said sheet such that said panels are sewn into place, said means for sewing positioned on said predetermined path.

2. The apparatus for manufacturing a pillow sham of claim 1, wherein said hemming means comprises one or more hemmers.

3. The apparatus for manufacturing a pillow sham of claim 2, wherein said hemmers comprise one or more sewing heads.

4. The apparatus for manufacturing a pillow sham of claim 2, wherein said hemmers comprise one or more fold elements.

5. The apparatus for manufacturing a pillow sham of claim 2, wherein said hemmers comprise one or more roller arms.

6. The apparatus for manufacturing a pillow sham of claim 2, wherein a first one of said one or more hemmers is positioned on a first side of said predetermined path.

7. The apparatus for manufacturing a pillow sham of claim 6, wherein a second one of said one or more hemmers is positioned on a second side of said predetermined path.

8. The apparatus for manufacturing a pillow sham of claim 1, wherein said means for folding said sheet along two substantially parallel fold lines to create a pillow sham front panel defined on two opposing edges by said fold lines, a pillow sham first back panel, and a pillow sham second back panel comprises one or more skis positioned over said predetermined path.

9. The apparatus for manufacturing a pillow sham of claim 8, wherein said means for folding said sheet along two substantially parallel fold lines to create a pillow sham front panel defined on two opposing edges by said fold lines, a pillow sham first back panel, and a pillow sham second back panel comprises one or more movable plates positioned adjacent to said skis, each of said one or more movable plates being dimensioned for moving an edge portion of said fabric from a first position below one of said one or more skis to a second position above said one or more skis.

10. The apparatus for manufacturing a pillow sham of claim 1, wherein said means for sewing one or more transverse edges of said sheet such that said panels are sewn into place comprises one or more sewing assemblies.

11. The apparatus for manufacturing a pillow sham of claim 10, wherein said sewing assemblies comprise one or more sewing heads.

12. The apparatus for manufacturing a pillow sham of claim 10, wherein a first one of said one or more sewing assemblies is positioned on a first side of said predetermined path.

13. The apparatus for manufacturing a pillow sham of claim 12, wherein a second one of said one or more sewing assemblies is positioned on a second side of said predetermined path.

14. The apparatus for manufacturing a pillow sham of claim 1, further comprising means for cutting said sheet from a continuous strip of material, said cutting means positioned on said predetermined path.

15. The apparatus for manufacturing a pillow sham of claim 14, further comprising means for pulling said continuous strip onto said predetermined path.

16. The apparatus for manufacturing a pillow sham of claim 15, wherein said means for pulling said continuous strip onto said predetermined path comprises an unwind assembly.

17. The apparatus for manufacturing a pillow sham of claim 16, wherein said unwind assembly comprises at least one sensor, such that said at least one sensor ensures that said continuous strip does not deviate from said predetermined path.

18. The apparatus for manufacturing a pillow sham of claim 15, wherein said means for pulling said continuous strip onto said predetermined path comprises a dancer assembly.

19. The apparatus for manufacturing a pillow sham of claim 15, wherein said means for pulling said continuous strip onto said predetermined path comprises a feed pull assembly.

20. The apparatus for manufacturing a pillow sham of claim 15, wherein said means for pulling said continuous strip onto said predetermined path comprises a push assembly.

21. The apparatus for manufacturing a pillow sham of claim 1, further comprising means for stacking said pillow shams, said stacking means positioned on said predetermined path.

22. An apparatus for manufacturing a pillow sham from a sheet of material, comprising:

one or more hemmers positioned on a predetermined path for hemming one or more lateral edges of said sheet;

a tri-fold assembly positioned on said predetermined path to provide at least two fold lines in said sheet such that said sheet is folded into a front panel defined on two opposing edges by said two fold lines, a first back panel, and a second back panel; and one or more sewing assemblies positioned on said predetermined path such that said panels are sewn into place.

23. The apparatus for manufacturing a pillow sham of claim 22, wherein said tri-fold assembly comprises one or more skis positioned over said predetermined path.

24. The apparatus for manufacturing a pillow sham of claim 23, wherein said tri-fold assembly comprises one or more movable plates positioned adjacent to said skis, each of said one or more movable plates being dimensioned for moving an edge portion of said fabric from a first position below one of said one or more skis to a second position above said one or more skis.

25. An apparatus for manufacturing a pillow sham from a continuous strip of material, comprising:

a feed pull assembly for pulling said continuous strip onto a predetermined path;

a cutting device positioned on said predetermined path for cutting a sheet from said continuous strip of material;

one or more hemmers positioned on said predetermined path for hemming one or more lateral edges of said sheet;

one or more skis positioned over said predetermined path;

one or more movable plates positioned adjacent to said skis such that said plates fold said sheet along at least two fold lines to create a front panel defined on two opposing edges by said two fold lines, a first back panel, and a second back panel; and one or more sewing assemblies positioned on said predetermined path for sewing said panels into place.

26. The apparatus for manufacturing a pillow sham of claim 25, further comprising means for stacking said pillow shams, said stacking means positioned on said predetermined path.

27. A tri-fold assembly for folding a sheet of material in a pillow sham apparatus, comprising:

one or more belts positioned on a predetermined path for advancing said sheet;

one or more skis positioned over said predetermined path;

one or more movable plates positioned adjacent to said skis such that when said belts advance said sheet under said skis, said plates fold said sheet over said skis along at least two fold lines to create a front panel defined on two opposing edges by said two fold lines, a first back panel defined on one edge by one of said two fold lines, and a second back panel defined on one edge by the other of said two fold lines.

28. A method for manufacturing a pillow sham from a continuous strip of material, comprising the steps of:

advancing said continuous strip of material along a predetermined path;

cutting a sheet from said continuous strip of material to provide said sheet with two opposing lateral edges and two opposing transverse edges;

hemming one or more lateral edges of said sheet;

folding said sheet along two parallel fold lines so as to create a front panel defined by said two fold lines, a first back panel, and a second back panel; and sewing one or more transverse edges of said sheet such that said panels are sewn into place.

29. An apparatus for manufacturing a pillow sham from a sheet of material, comprising:

means for hemming one or more lateral edges of said sheet, said means for hemming positioned on a predetermined path;

means for folding said sheet to create a front panel, a first back panel attached along a first fold line to said front panel, and a second back panel attached along a second fold line to said front panel and at least partially overlapping said first back panel, said means for folding positioned on said predetermined path; and means for sewing one or more transverse edges of said sheet such that said panels are sewn into place, said means for sewing positioned on said predetermined path;

wherein said first back panel comprises an overlapped portion overlapped by said second back panel and a non-overlapped portion not overlapped by said second back panel; and wherein said second back panel comprises an overlapping portion overlapping said first back panel and a non-overlapping portion not overlapping said first back panel.

30. The apparatus for manufacturing a pillow sham of claim 29 wherein a surface area of said non-overlapped portion of said first back panel is greater than a surface area of said overlapped portion of said first back panel.

31. The apparatus for manufacturing a pillow sham of claim 29 wherein a surface area of said non-overlapping portion of said second back panel is greater than a surface area of said overlapping portion of said second back panel.

32. The apparatus for manufacturing a pillow sham of claim 30 wherein a surface area of said non-overlapping portion of said second back panel is greater than a surface area of said overlapping portion of said second back panel.

* * * * *